US008773234B2

(12) United States Patent
Maeda

(10) Patent No.: US 8,773,234 B2
(45) Date of Patent: Jul. 8, 2014

(54) TRANSFORMER

(71) Applicant: TDK Corporation, Tokyo (JP)

(72) Inventor: Hiroshi Maeda, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 13/691,640

(22) Filed: Nov. 30, 2012

(65) Prior Publication Data

US 2013/0135073 A1 May 30, 2013

(30) Foreign Application Priority Data

Nov. 30, 2011 (JP) ..... 2011-262878

(51) Int. Cl.
*H01F 27/30* (2006.01)
*H01F 27/28* (2006.01)
*H01F 27/29* (2006.01)

(52) U.S. Cl.
USPC ..... 336/208; 336/170; 336/192; 336/198; 336/222

(58) Field of Classification Search
CPC ..... H01F 2005/025; H01F 27/325
USPC ..... 336/192
See application file for complete search history.

(56) References Cited

U.S. PATENT DOCUMENTS

| | | | | |
|---|---|---|---|---|
| 4,639,706 | A * | 1/1987 | Shimizu | 336/170 |
| 6,064,291 | A * | 5/2000 | Urabe et al. | 336/222 |
| 6,696,908 | B2 * | 2/2004 | Okano et al. | 336/198 |
| 7,301,430 | B1 * | 11/2007 | Chan et al. | 336/200 |
| 7,528,694 | B2 * | 5/2009 | Tseng et al. | 336/212 |
| 8,018,314 | B2 * | 9/2011 | Zeng et al. | 336/208 |

FOREIGN PATENT DOCUMENTS

| | | |
|---|---|---|
| JP | 7-010924 | 2/1995 |
| JP | 2009-283675 A | 12/2009 |

* cited by examiner

*Primary Examiner* — Elvin G Enad
*Assistant Examiner* — Ronald Hinson
(74) *Attorney, Agent, or Firm* — Muncy, Geissler, Olds & Lowe, P.C.

(57) ABSTRACT

A transformer is provided having good workability during production and good connection of the secondary main coil and the primary supportive coil. The transformer has a bobbin with a base part and first hollow cylinder part with a first through hole and a core projecting in a first positive direction from said base part, and a case having an upper collar part formed with a primary main coil wound around said first hollow cylinder part, a second through hole leading to said first through hole, and a second hollow cylinder part formed at the outer peripheral face. Said primary main coil is housed and projects in a first negative direction from said upper collar part. A lower collar part opposes said base part by extending approximately parallel to said mounting face. The primary supportive coil and secondary main coil are wound around said first and second sections, respectively.

3 Claims, 4 Drawing Sheets

TRANSFORMER

BACKGROUND OF THE INVENTION

1. Field of the Invention

The present invention relates to a suitable transformer used together with a power source IC transformer for resonance.

In an electric power source part of an electronic device, there is those including a resonance transformer used together with the power source IC for resonance. As for transformer used as such resonance transformer, the properties corresponding to the function of the power source IC may be demanded. For example, the resonance transformer used together with the power source IC having stand-by (STBY) function may be demanded to improve the connection of the primary supportive coil and the secondary main coil.

As for the resonance transformer which has accomplished a good connection between the primary supportive coil and the secondary main coil, the primary coil is provided at the both sides of the secondary main coil, then the barrier tape is wound around the outer peripheral side of the secondary coil for the insulation, and further winding the primary supportive coil, is proposed (refer to Patent article 1). Also, separately from this, in order to make the transformer shorter, the transformer providing the coil axis parallel to the mounting face are proposed (refer to Patent article 2).

2. Brief Discussion of the Prior Art

Patent article 1: JP Utility model Publication No. H07-10924

Patent article 2: JP Patent Application Publication No. 2009-283675

In the above described conventional technology, after winding the barrier tape around the outer peripheral of the secondary main coil, in order to wind the primary supportive coil thereover, it took too much time to wind the barrier tape, thus the workability during the production was a problem.

The present invention was accomplished in view of such situation, and the object of the present invention is to provide the transformer having good workability during the production, and having a good connection between the secondary main coil and the primary supportive coil.

SUMMARY OF THE INVENTION

The transformer according to the present invention comprises; a bobbin comprising a base part extending approximately parallel to a mounting face, and a first hollow cylinder part formed at inside with a first through hole inserted by a core projecting out towards a first positive direction approximately perpendicular against said mounting face from said base part, a primary main coil wound around said first hollow cylinder part, a case comprising an upper collar part, a second hollow cylinder part and a lower collar part, said upper collar part formed with a second through hole connecting to said first through hole and extending approximately parallel to said mounting face, said second hollow cylinder part housing said primary main coil inside by projecting out towards a first negative direction which is an opposite direction of said first positive direction from said upper collar part and formed at an outer peripheral face with a first and second section divided by an intermediate collar part projecting out approximately parallel to said mounting face, and said lower collar part connected to an end part opposite to said upper collar part in said second hollow cylinder part and opposing said base part by extending approximately parallel to said mounting face, a primary supportive coil wound around said first section, and a secondary main coil wound around said second section.

The transformer according to the present invention has a structure wherein a second hollow cylinder part which function as a bobbin main body of the secondary main coil is provided at the outer peripheral side of a first hollow cylinder part which functions as the bobbin main body of the primary main coil, thereby it has a double layer structure wherein the secondary main coil wind around the outer peripheral of the primary main coil. Therefore, the transformer according to the present invention has accomplished to shorten even for a vertical type transformer, and also the present invention can suppress the leakage flux in the vertical direction. Further, the present inventors according to the present invention has found that by having a double layer structure as the present invention, even if the primary supportive coil is provided by shifting in the vertical direction (the first positive direction and the first negative direction) with respect to the secondary main coil, a good connection between the primary supportive coil and the secondary main coil can be achieved. The transformer according to the present invention utilize the advantage of such structure, and by winding the primary supportive coil to other section separated by an intermediate collar part from the section where the secondary main coil is provided, the step for winding the barrier tape around the outer peripheral of the secondary main coil is not needed; thereby the workability during the production is improved. Therefore, the present invention accomplished a good connection between the primary supportive coil and the secondary main coil, can easily ensure the secure insulation between the primary supportive coil and the secondary main coil, has excellent productivity, and can accomplish to make shorter. Also, the transformer according to the present invention can shorten the length of the legs of the core which is inserted to the hollow cylinder part, and enhance the strength of the core.

Also, for example, in the transformer according to the present invention, at a first end part which is an one end part of said base part and an end part of a second positive direction approximately parallel to said mounting face, 4 or more of primary terminals connected with both end parts of said primary main coil and said primary supportive coil may be provided, at a second end part which is other end part of said base part, plurality of secondary terminals connected with both end parts of said secondary main coil may be provided, and said first end part may be spaced apart from said second end part in regards with said second direction, further than a lower collar part end part which is an end part of said second positive direction at said lower collar part.

By providing the primary terminals of which the both end parts of the primary main coil and primary supportive coil are wound at one end part of the base part, and providing secondary terminals of which the both end parts of the secondary main coil is wound at other end of the base part; a good insulation at the primary side and the secondary side can be ensured. Also, by making the lower collar part shorter than the first end part of the base part, even after the bobbin and the case are assembled, the primary terminal provided at the first end part are prevented from being covered by the case, thereby when the both ends of the primary supportive coil are wound to the first end part or when soldering the primary supportive coil, the case is prevented from intervening, or the case is prevented from being partially damaged.

Also, for example, said primary supportive coil may be provided so that it is closer to said lower collar part than with said secondary main coil.

As such transformer, the primary supportive coil is closer to lower collar part and the first end part of the base part, therefore the connection of the primary supportive coil and the primary terminals are easy.

DETAILED DESCRIPTION OF THE PREFERRED EMBODIMENTS

In the following, the present invention is described based on the embodiment shown in the figure.

Figure 1:
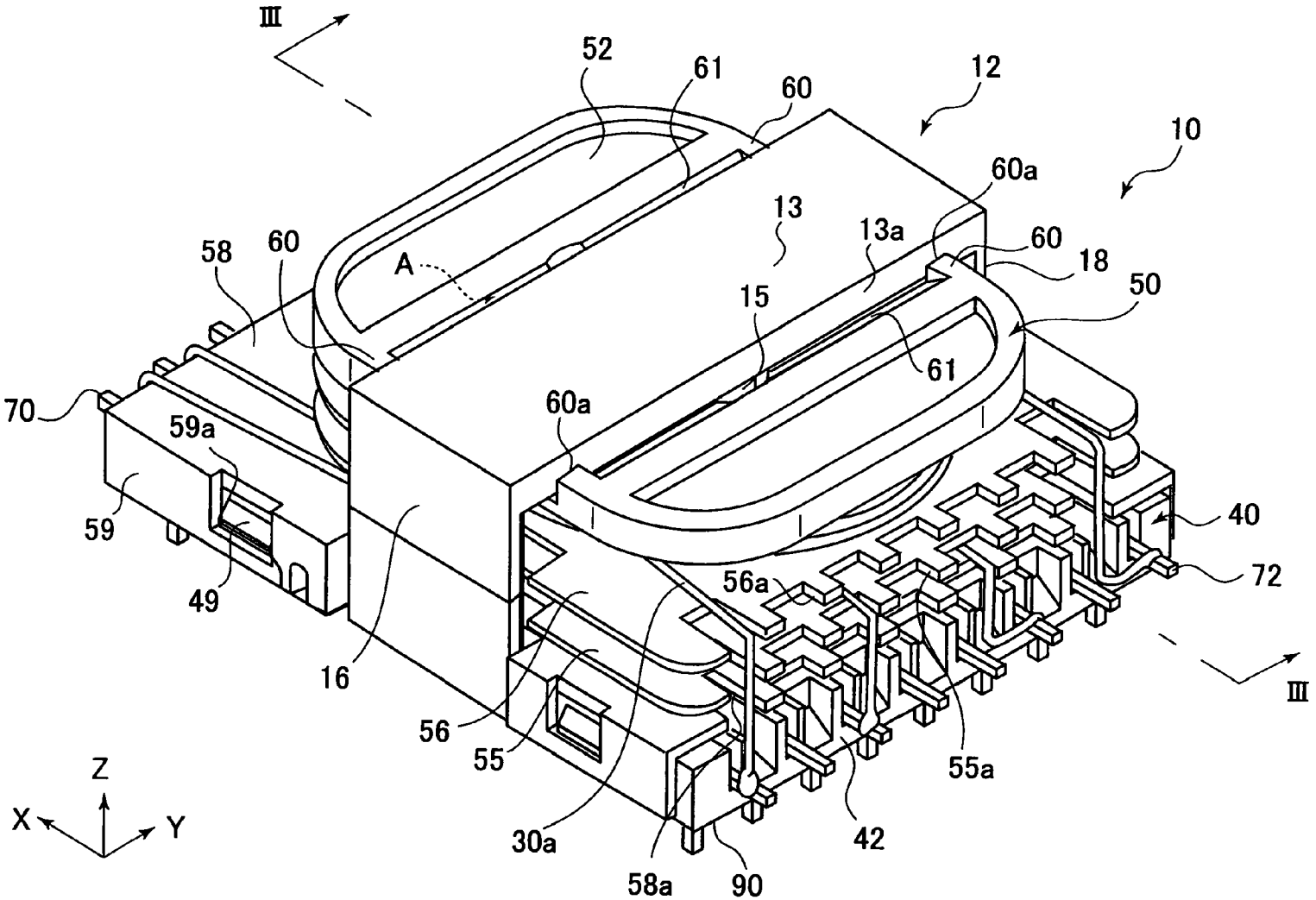
FIG. 1 shows the overall perspective view of the transformer according to the present invention.
Figure 3:
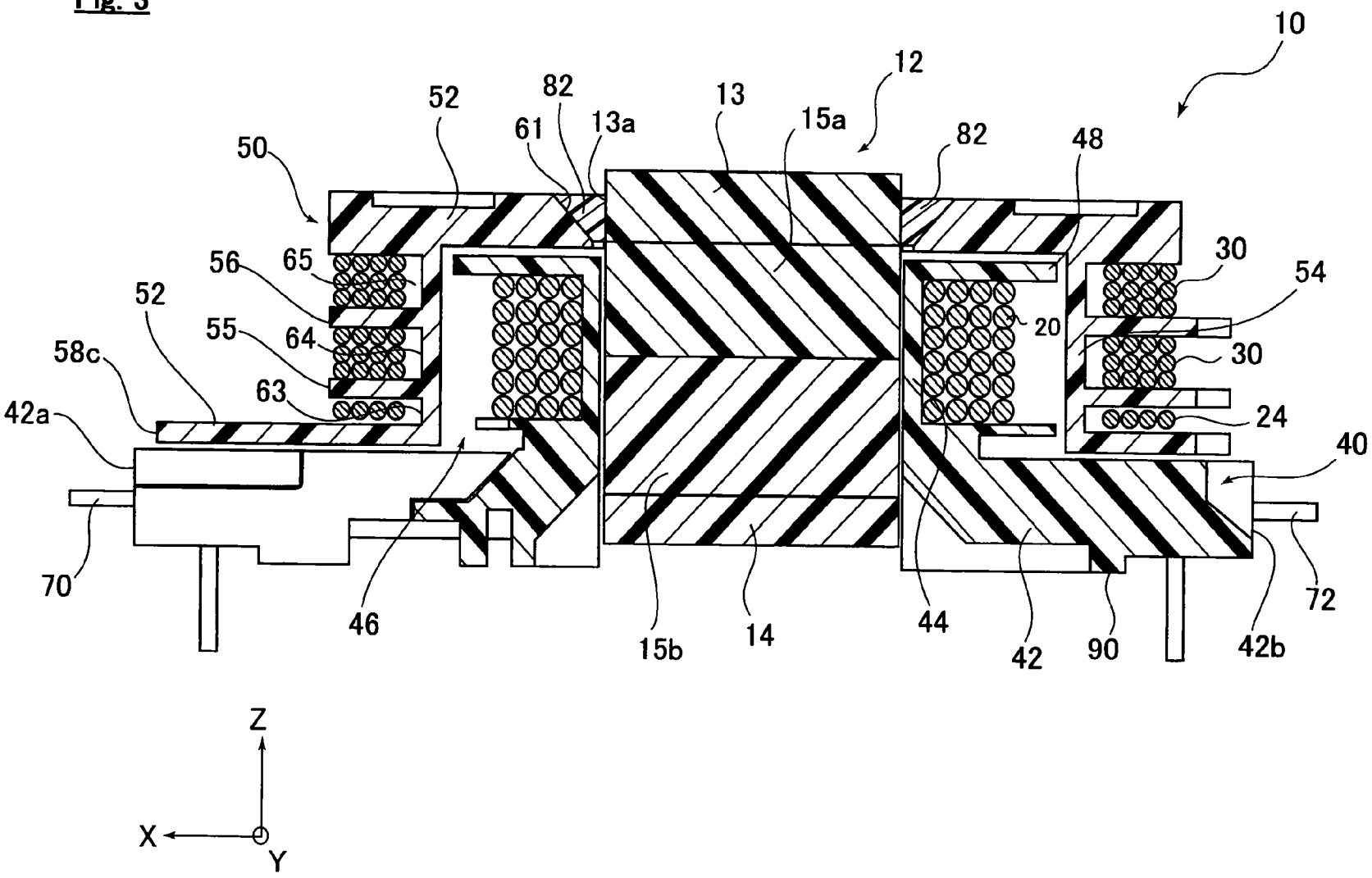
FIG. 3 is a cross sectional view of the transformer at vertical cross section to the mounting face.

As shown in FIG. 1, the transformer 10 according to one embodiment of the present invention comprises a core 12, a case 50, and a bobbin 40. Also, as shown in FIG. 3 which is the cross sectional view of FIG. 1, the primary main coil 20, and the primary supportive coil 24 and the secondary main coil 30 are wound around the case 50 and the bobbin 40.

The core 12 shown in FIG. 1 is constituted by a soft magnetic material such as ferrite or so, and forms flux path allowing the magnetic flux to pass thorough which is generated by the primary main coil 20, the primary supportive coil 24 and the secondary main coil 30 which will be described in below. The core 12 comprises a middle leg 15, side legs 16 and 18, a first connection part 13 and a second connection part 14 (refer to FIG. 2). The middle leg 15 of the core 12 extends along the first direction (Z axis direction in the figure) which is perpendicular to the mounting face, and inserted to the inner peripheral side of the primary main coil 20, the primary supportive coil 24 and the secondary main coil 30. The side legs 16 and 18 extends along the Z axis direction as similar to the middle leg 15, and it has approximately the same length as the middle leg 15. The side legs 16 and 18 are provided so that the middle leg 15 is sandwiched therebetween in Y axis direction.

Figure 2:
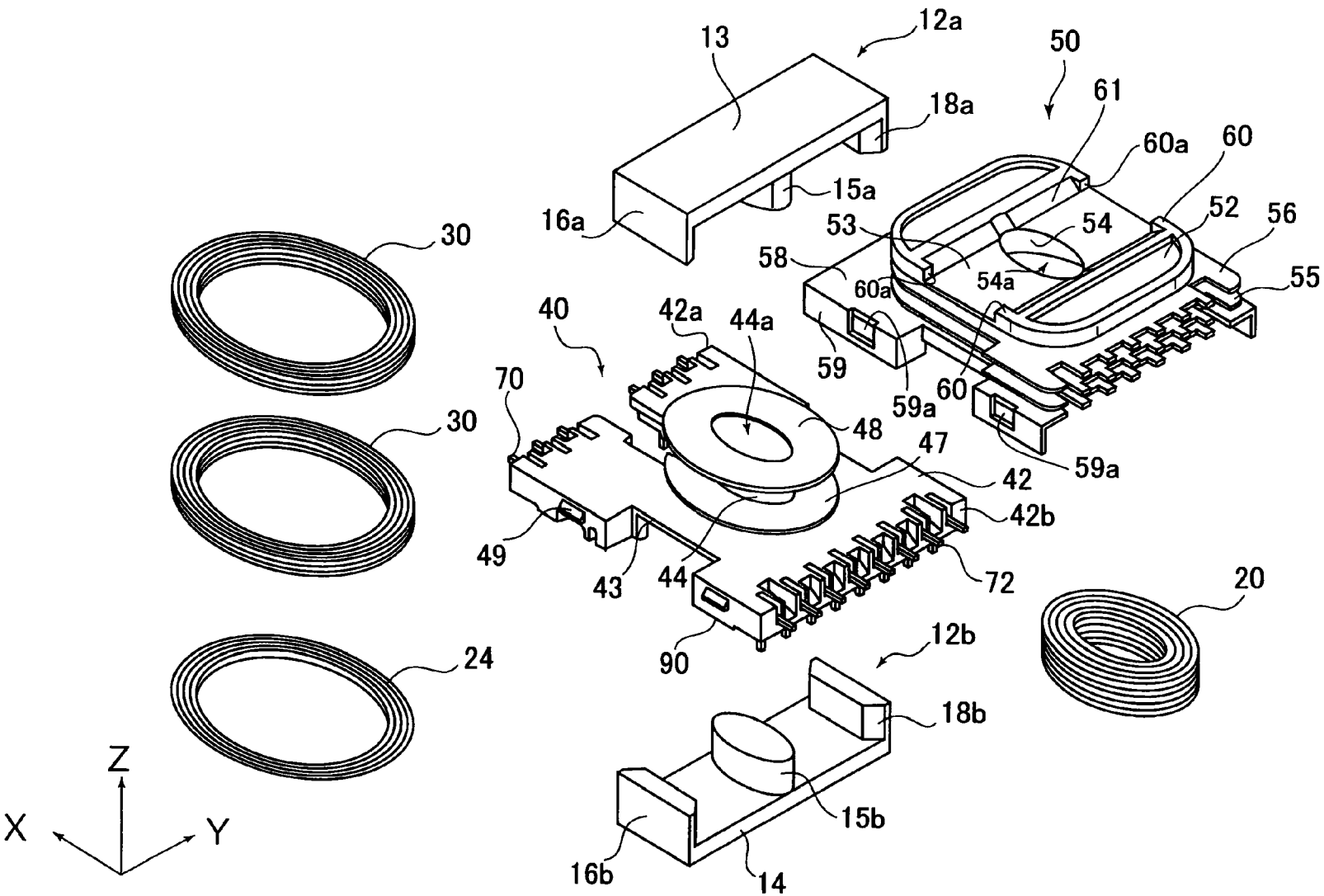
FIG. 2 shows the exploded perspective view of the transformer shown in FIG. 1.

As shown in FIG. 1 and FIG. 2, the first connection part 13 of the core 12 is in a parallel direction to the mounting face 90, extends approximately parallel to the third direction (Y axis direction of figure) which is the direction connecting the middle leg 15 and side legs 16 and 18, and connects one end part of the middle leg 15 and one end part of the side legs 16 and 18. On the contrast, the second connection part 14 of the core 12 is, as shown in FIG. 2, extends approximately parallel to Y axis direction as similar to first connection part 13, and connects other end part of the middle leg 15 and other end part of the side legs 16 and 18. In the present embodiment, among the connection parts 13 and 14 which connects the middle leg 15, and the side legs 16 and 18, the side spaced apart from the mounting face 90 of the transformer 10 (refer to FIG. 1) is defined as the first connection part 13, and the side closer to the mounting face 90 than the first connection part 13 is defined as the second connection part 14. Note that, on the opposite of this, the embodiment defining the side spaced apart from the mounting face 90 of the transformer 10 as the second connection part, and defining the side closer to the mounting face 90 than the second connection part as the first connection part is also included as the embodiment of the present invention. Note that, the mounting face 90 of the transformer 10 refers to the bottom face of the transformer 10 opposing against the substrate when the transformer 10 is mounted to the substrate. As shown in FIG. 1, the mounting face 90 is a face parallel to XY plane.

The core 12 is, as shown in FIG. 2, formed by assembling the first core 12*a* and the second core 12*b* which are two components formed separately. The first core 12*a* and the second core 12*b* have symmetrical shape, and it is connected with each other by sandwiching the case 50 and the bobbin 40 in the vertical direction (Z axis direction of the figure). The first core 12*a* and the second core 12*b* have approximately E shape in the longitudinal cross section (the cross section including Y axis and Z axis in FIG. 1) respectively.

Note that, the figures, Z axis (the first direction) is a height direction of the transformer 10, and as the height in Z axis direction of the transformer 10 becomes shorter, the transformer can be made shorter. Also, X axis and Y axis are perpendicular to each other, and also perpendicular to Z axis. In this embodiment, Y axis matches with the array direction of the primary terminal 70 and the secondary terminal 72, and with the connection direction (the third direction) of the middle leg 15 and the side legs 16 and 18; and X axis matches with the direction (the second direction of FIG. 3 and FIG. 4) connecting the first end part 42*a* and the second end part 42*b* in the base part 42 of the bobbin 40.

As shown in FIG. 2, the bobbin 40 extends approximately parallel to the mounting face 90, and the base part 42 of the approximate rectangular plate shape. At a part of the lower surface of the base part 42, the mounting face 90 of the transformer 10 is formed.

At the first end part 42*a* which is one end part of base part 42 and an end part of X axis positive direction (the second positive direction), 4 or more (the example shown in figure is 6) of the primary terminals 70 are fixed in predetermined spacing along Y axis direction. Also, at the second end part 42*b* which is other end part of the base part 42, plurality of secondary terminals 72 (the example in the figures is 8) are fixed in a predetermined spacing along Y axis direction.

These primary terminals 70 and the secondary terminals 72 are constituted for example by metal terminals, and molded as one body by insert molding or so against the base part 42 which is constituted by insulation material such as synthetic resin or so. As it will be described in below, at the primary terminals 70, the primary coil end part 20*a* which is the both end parts of the primary main coil 20, and the supportive coil end part 24*a* which is the both end parts of the primary supportive coil 24 are connected, and the secondary terminals 72 are connected to the secondary coil end part 30*a* which is the both end parts of secondary main coil 30 (refer to FIG. 4). As such, the base part 42 has a function as the terminal mounting part where the terminals 70 and 72 electrically connected with the coils 20, 24, 30 are mounted.

At the approximate center position of the base part 42, the first hollow cylinder part 44 (refer to FIG. 3) is projecting out from the base part 42 towards Z axis positive direction (the first positive direction). At the base part 42 and the first hollow cylinder part 44, the first thorough hole 44*a* is formed which penetrates through these in Z axis direction. The opening shape of the through hole 44*a* is an oval shape which also matches with the shape of the second through hole 54*a* formed at the case 50 which will be explained in below; and as shown in FIG. 3, the middle leg 15 (15*a* and 15*b*) at the core 12 (the first core 12*a* and the second core 12*b*) is inserted therein.

As shown in FIG. 2, at the outer peripheral face of the first hollow cylinder part 44, the first bobbin collar part 47 and the second bobbin collar part 48 which projects out approximately parallel to the mounting face 90 are provided. The first bobbin collar part 47 is provided near by the lower end part at the first hollow cylinder part 44, and the second bobbin collar part 48 is connected at the upper end part of the first hollow cylinder part 44. The first bobbin collar part 47 and the second bobbin part 48 has a function to hold the primary main coil 20 in the vertical direction (Z axis direction). The base part 42, the first hollow cylinder part 44 and the bobbin parts 47, 48 are preferably molded as one body by injection molding or so.

As shown in FIG. 3, at the outer peripheral of the first hollow cylinder part 44, the primary main coil 20 is wound around. Therefore, the first hollow cylinder part 44 functions as the bobbin main body of the primary main coil 20.

The primary main coil 20 has, as shown in FIG. 2 and FIG. 3, a shape following the outer peripheral shape of the first hollow cylinder part 44, and as similar to the first hollow cylinder part 44, it has an oval shape. The primary main coil 20 is, as shown in FIG. 2 and FIG. 3, made so that it houses inside of the second hollow cylinder part 54 of the case 50 which will be described in below, and provided at inner peripheral side of the primary supportive coil 24 and the secondary main coil 30 which are wound around the outer peripheral of the second hollow cylinder part 54.

As shown in FIG. 2, at the both side faces of Y axis of the base part 42, the concave part 43 is formed allowing the side legs 16*b* and 18*b* of the second core 12*b* to pass through. The concave part 43 is provided so that the position of X axis direction is same as the first hollow cylinder part 44. Also, at the both side faces of Y axis direction of the base part 42, in the both sides position of X axis direction of the concave part 43, the engaging projection 49 is formed which engages in removable manner at the engaging hole 59*a* of the case 50 which will be described in below.

As shown in FIG. 1 and FIG. 2, the case 50 holds the primary supportive coil 24 and the secondary main coil 30 (refer to FIG. 3), and defines a part of the outer shape of the transformer 10. The case 50 comprises, as shown in FIG. 2, upper collar part 52, the second hollow cylinder part 54 to which the second main coil winds around, and the lower collar part 58. The second hollow cylinder part 54 functions as the bobbin main body of the primary supportive coil 24 and the secondary main coil 30.

As shown in FIG. 1, the upper collar part 52 extends approximately parallel to the mounting face 90. Also, as shown in FIG. 3, the upper collar part 52 is connected to the upper end part of the second hollow cylinder part 54. As shown in FIG. 2, to the upper collar part 52, the second through hole 54*a* leading to the first through hole 44*a* of the bobbin 40 is formed, and at the second through hole 54*a*, the middle leg 15*a* of the first core 12*a* is inserted.

As shown in FIG. 1, at the upper surface of the upper collar part 52, the core mounting face 53 extending approximately parallel to the mounting face 90 is formed. The core mounting face 53 is, as shown in FIG. 3, connected to the end part (the upper end part of the second hollow cylinder part 54) of the side close to the first connection part 13 at the second hollow cylinder part 54. The core mounting face 53 is opposing to the first connection part 13 of the core part 12, and under the condition that the transformer 10 is assembled, the first connection part 13 of the core 12 is being mounted on the core mounting face 53 (refer to FIG. 2).

As shown in FIG. 1 to FIG. 3, at the both sides of X axis direction of the core mounting face 53 of the case 50, the inclined face 61 is formed. As shown in FIG. 1, under the condition that the transformer 10 is assembled, the inclined face 61 sandwiches the first connection part 13 of the core 12 in X axis direction, thereby provided at both sides. As shown in FIG. 1 and FIG. 3, the inclined face 61 is an inclined face gradually rising to the upper direction (Z axis positive direction) from the core mounting face 53.

The inclined face 61 is constituted by the face inclining towards the diagonal upper direction from the core mounting face 53, and function as the adhering face of the adhesive agent for fixing the core 12 against the case 50. As shown in FIG. 3, in between the first connection part side face 13*a* of the core 12 and the inclined face 61, the adhesive agent curing part 82 is formed. The adhesive agent 82 connects the inclined face 61 of the case 50 and the first connection part side face 13*a* of the core 12, and fixes the core 12 against the case 50. Note that, the first connection part side face 13*a* is the face extending in the direction crossing with the core mounting face 53 at the first connection part 13, and in the present embodiment, it extends in the direction approximately perpendicular against the core mounting face 53.

Also, as shown in FIG. 1 and FIG. 2, at the both sides of X axis direction of the core mounting face 53 of the case 50, in addition to the inclined face 61, the positioning part 60 is formed which determines the position of the first connection part 13 of the core 12. The positioning part 60 projects out to Z axis positive direction (the first positive direction) from the core mounting face 53. As shown in FIG. 1, the positioning part 60 is formed by placing the first connection part 13 therebetween.

The positioning part 60 contacts with the first connection part 13, or comprise the positioning face 60*a* which is the part closest to the first connection part 13 among the positioning part 60. As shown in FIG. 1, the positioning face 60*a* is formed so that it rises approximately perpendicular from the core mounting face 53, and it is opposing against the first connection part side face 13*a* which is the side face of the first connection part 13; thereby it can carry out the positioning of X axis direction of the first connection part side face 13*a*.

The positioning face 60*a* is preferably provided in pluralities by taking a predetermine space along the direction approximately parallel to Y axis direction (the third direction). In the present embodiment, total of four positioning faces 60*a* are provided, two at both end parts of Y axis direction of the core mounting face 53, and at the space between the positioning face 60*a* provided at the both end parts, above mentioned inclined face 61 is placed. The inclined face 61 is formed so that it connects the positioning part 60 provided at the both end parts, and has a function to improve the strength of the upper collar part 52 and the case 50.

At the positioning part 60 (shown in FIG. 1), at the inclined face 61 and the area surrounded by the first connection part side face 13*a* (the area shown by the arrow A of dotted line), the adhesive agent curing part 82 is formed. The adhesive agent curing part 82 shown in FIG. 3 has been cured the adhesive agent for adhering the first connection part 13 of the core 12 and the case 50. The adhesive agent curing part 82 extends in Y axis direction along the inclined face 61 and the first connection part side face 13*a*. The adhesive agent curing part 82 is in contact with the first connection part side face 13*a* and the inclined face 61. This can be observed at the cross section passing through the middle leg 15 (15*a* and 15*b*), and also it is same at the cross section passing through between the middle leg 15 and the side legs 16 and 18. Note that, at FIG. 1 and FIG. 4, the adhesive agent curing part 82 is not shown in order to show the shape of the inclined face 61 or so of the case 50.

Though it is not shown in FIG. 1, as shown in FIG. 3, the second hollow cylinder part 54 of the case 50 project out towards Z axis negative direction (the first negative direction), which is the opposite direction of Z axis positive direction, from the upper collar part 52. The second hollow cylinder part 54 has a shape covering the outer peripheral of the first and the second bobbin collar part 47 and 48 as shown in FIG. 2, and as shown in FIG. 3, it houses the primary main coil 20 and the middle leg 15 (15*a*, 15*b*) at inside.

As shown in FIG. 2, at the outer peripheral face of the second hollow cylinder part 54, the first intermediate collar part 55 and the second intermediate collar part 56 which is approximately parallel to the mounting face 90 are provided. As shown in FIG. 3, at the outer peripheral face of the second hollow cylinder part 54, the first section 63, the second section 64 and the third section 65 are formed which are divided by these first intermediate collar part 55 and the second intermediate collar part 56. Each section 63, 64, 65 are provided sequentially along Z axis direction.

At the first section 63, the primary supportive coil 24 is wounded, and at the second section 64 and the third section 65, the secondary main coil 30 is wound. The first intermediate collar part 55 which divides the first section 63 and the second section 64 has a function to ensure the secure insulation of the primary supportive coil 24 and the secondary main coil 30. The second intermediate collar part 56 which divides the second section 64 and the third section 65 is provided to divide the secondary main coil 30 along Z axis direction, and it is provided depending on the use of the transformer 10. In the present embodiment, the outer peripheral face of the second hollow cylinder part 54 is divided into three sections; however the numbers of the sections are not particularly limited as long as the primary supportive coil 24 and the secondary main coil 30 can be provided in the separate section.

As shown in FIG. 1 and FIG. 3, at the end part of the opposite side of the upper collar par 52 in the second hollow cylinder part 54, the lower collar part 58 extending approximately parallel to the mounting face 90 is connected. The lower collar part 58 has planar shape such as rectangular shape, and opposes the base part 42 of the bobbin 40; thereby it is provided so as to cover the upper surface of said base part 42.

At the both sides of the end part of Y axis direction of the lower collar part 58, the side face part 59 projecting out towards the lower part is formed. At the side face part 59, the engaging projections 49 of the bobbin 40 which engages with the engaging hole 59*a* are formed. The case 50 and the bobbin 40 are assembled by engaging the engaging projections 49 to the engaging hole 59*a* by using the resilient deformation of the side face part 59.

The case 50 comprising the upper collar part 52, the second hollow cylinder part 54 and the lower collar part 58 is formed as one body by injection molding or so. As shown in FIG. 3, at the second section 64 and the third section 65 of the second hollow cylinder part 54, the secondary main coil 30 is wound; and the transformer 10 has a double layer structure wherein the primary main coil 20 and the secondary main coil 30 winds twice around the middle leg 15 of the core 12.

As shown in FIG. 2 and FIG. 3, the secondary main coil 30 of the present embodiment is constituted by two independent coils, however the secondary main coil may be constituted by one coil, or it may be constituted by three or more coils. Also, the secondary main coil 30 and the primary supportive coil 24 is in contact with the second hollow cylinder part 54, and the coiling shape of the secondary main coil 30 and the primary supportive coil 24 and the outer peripheral shape of the second hollow cylinder part 54 is oval shape.

As shown in FIG. 1, the tip end part of X axis negative direction (the second negative direction) of the first intermediate collar part 55 and the second intermediate collar part 56 extends to the end part of the base part 42 formed with the secondary terminal 72, and the lead groove part 55*a* and 56*a* are formed which guides the secondary main coil end part 30*a* of the end part of the secondary main coil 30 to the secondary terminal 72. Also, the lower collar part 58 of the case 50 extends to the end part of X axis negative direction of the base part 42 as similar to the intermediate collar part 55 and 56, and the lead groove part 58*a* is formed which guides the secondary coil end part 30*a* to the secondary terminal 72. Note that, the transformer 10 according to the present embodiment is a resonance transformer used together with the power source IC for resonance comprising the stand-by function, and the primary main coil 20 is a magnetic excitation coil, a secondary main coil 30 is output coil and the primary supportive coil 24 is the coil for driving the power source IC.

The transformer 10 according to the present embodiment is produced by assembling each members shown in FIG. 2, and winding the coil around the bobbin 40 and the case 50. Hereinafter, an example of the production method of the transformer 10 will be explained using FIG. 2 and FIG. 4 or so. For the production of the transformer 10, first, the bobbin 40 installed with primary terminals 70 and the secondary terminals 72 are prepared. The material of the bobbin 40 is not particularly limited; however the bobbin 40 is formed by insulation material such as resin or so, and particularly, using the phenol resin or so is preferable from the point of heat resistance or so.

Next, the wire is wound around the first hollow cylinder part 44 of the bobbin 40 to form the primary main coil 20 (refer to FIG. 3). As for the wire used for forming the primary main coil 20, it is not particularly limited; however the litz wire or so is suitably used. Also, as shown in FIG. 1, the primary coil end part 20*a* which is the both end part of the primary main coil 20 is connected by winding to the primary terminal 70 via the connecting path 46 of the bobbin 40 (refer to FIG. 3). Note that, the soldering between the primary main coil end part 20*a* and the primary terminal 70 may be carried out at this time; however it is better in terms of the operation efficiency to carry out the soldering together with the adjacent primary terminal 70 and the supportive coil end part 24*a* after the primary supportive coil 24 has been formed.

Next, to the bobbin 40 formed with the primary main coil 20, the case 50 shown in FIG. 2 is installed. The case 50 and the bobbin 40 are assembled by engaging the engaging hole 59*a* of the case 50 to the engaging projection 49 of the bobbin 40. Also, the case 50 and the bobbin 40 may be fixed by adhering or so if needed. The material of the case 50 is not particularly limited, and it is formed by the insulation material such as resin or so, and particularly, using the PET (polyethylenetelephthalate) or so is preferable from the point of easy resilient deformation.

Figure 4:
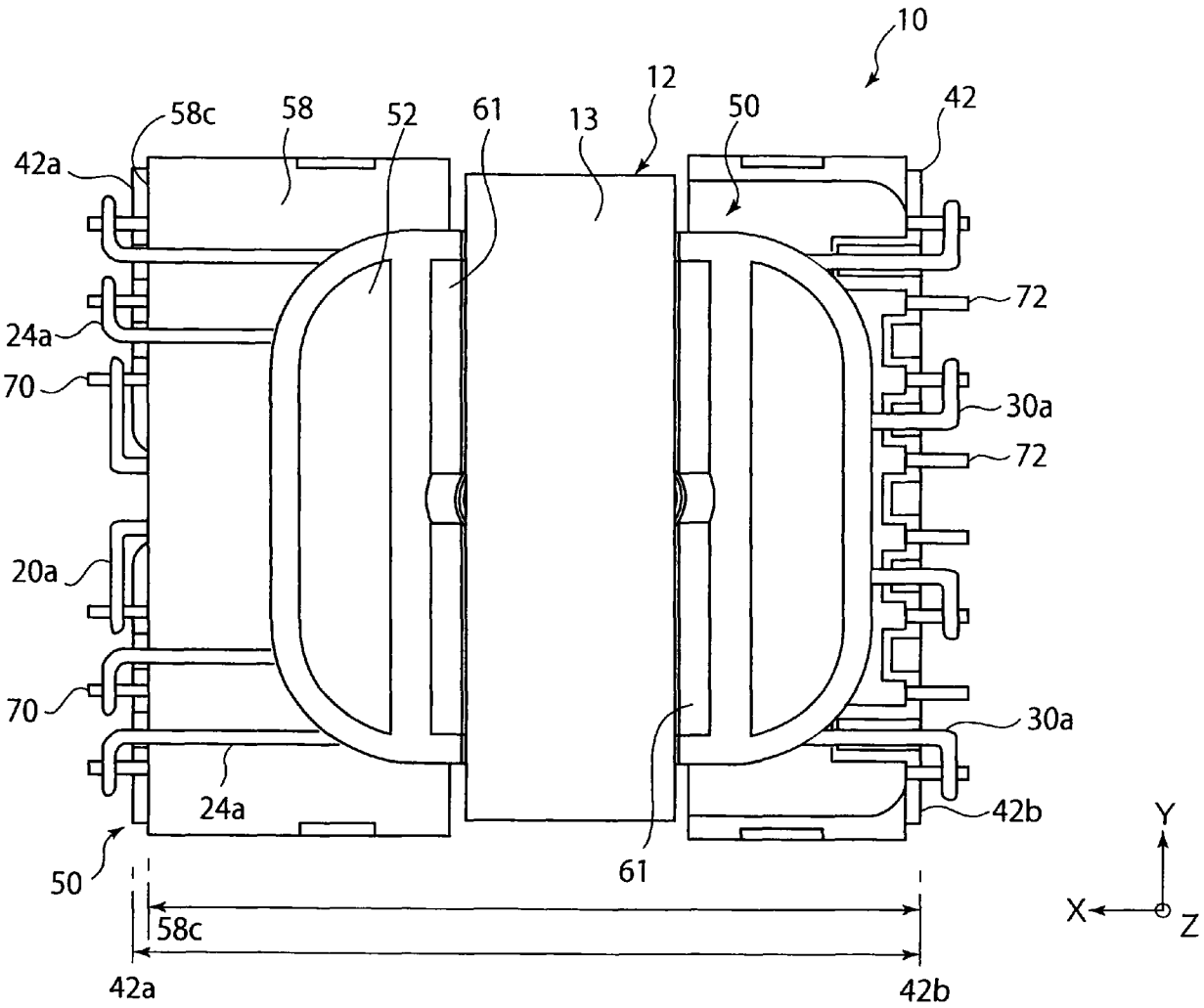
FIG. 4 is the top view of the transformer.

Next, the wire is wound around the second hollow cylinder part 54 of the case 50 to form the primary supportive coil 24 and the secondary main coil 30 (refer to FIG. 3). As for the wire used for forming the primary supportive coil 24 and the secondary main coil 30, it is not particularly limited; however the litz wire or so is suitably used. The supportive coil end part 24*a* which is the end part of the primary supportive coil 24 is connected by winding to the primary terminal 70 by passing over the lower collar part 58 as shown in FIG. 4. As shown in FIG. 3, in the transformer 10 according to the present embodiment, the primary supportive coil 24 is provided at the first section 63 near by the lower collar part 58, thus the connection of the supportive coil end part 24 and the primary terminal 70 is easy.

Also, as shown in FIG. 4, the first end part 42*a* at the base part 42 of the bobbin 40 is spaced apart from the second end part 42*b* in regards with X axis positive direction (the second direction), further than the lower collar part 58*c* in the lower collar part 58 of the case 50, and when observing from the top side of the transformer 10, the first end part 42*a* projects out in X axis direction from the lower collar end part 58*c*. Therefore, during the assembling of the transformer 10, after the case 50 is mounted to the bobbin 40, the wire can be easily pulled to the primary terminals 70 from the second hollow cylinder part 54 of the case 50. Note that, the lower collar end part 58*c* is an end part of X axis positive direction (the second positive direction) of the lower collar part 58.

As shown in FIG. 3, the secondary main coil 30 is provided at the second section 64 and the third section 65 of the second hollow cylinder part 54, and as shown in FIG. 1 and FIG. 4, the secondary main coil end part 30*a* which is the both end parts of the secondary main coil 30 is wound around the secondary terminals 72 by engaging to the lead groove parts 55*a*, 56*a*, 58*a*. After the primary supportive coil 24 and the secondary main coil 30 are formed, each coil end part 20*a*, 24*a*, and 30*a* are soldered with the primary terminals 70 or the secondary terminals 72.

Next, to the intermediate assembly which is assembled with the primary main coil 20, the primary supportive coil 24, the secondary main coil 30, the case 50, and the bobbin 40, the first core 12*a* and the second core 12*b* are mounted from the vertical direction of Z axis direction; thereby the core 12 is formed. That is, each of the tip parts of the middle legs 15*a* and 15*b*, each of the tip parts of side legs 16*a* and 16*b*, and each of the tip parts of the side legs of 18*a* and 18*b* of the first core 12*a* and the second core 12*b* are connected respectively. Note that, in between the tip parts of the middle legs 15*a* and 15*b*, a gap may be provided. The first core 12*a* and the second core 12*b* of the core 12 may be adhered by using the adhesive agent. As for the material of the core 12, a metal, a soft magnetic material such as ferrite or so may be mentioned, however it is not limited thereto.

Next, in between the first connection part side face 13*a* and the inclined face 61 which is indicated by arrow A in FIG. 1, the adhesive agent is coated, and by forming the adhesive agent curing part 82 shown in FIG. 3, the core 12 is fixed against the case 50. The adhesive agent forming the adhesive agent curing part 82 is not particularly limited, however it is preferable to use the adhesive agent having relatively high viscosity such as silicon adhesive agent or so, from the point of the use for connecting the first connection part side face 13*a* and the inclined face 61 which extends in the direction crossing against each other. Also, the space formed between the first connection part side face 13*a* and the top end part of the inclined face 61 is designed to have a width so that a nozzle for discharging the adhesive agent can suitably approach to the coating face.

Lastly, a tape may be wound around the outer peripheral, and a varnish impregnation may be carried out. The transformer 10 according to the present embodiment can be produced by the steps mentioned hereinabove.

In the transformer of single layer structure according to a conventional technology, the secondary main coil is provided so that it is shifted in the coil direction with respect to the primary main coil, thus the primary supportive coil is wound via the insulation tape at the outer peripheral of the secondary main coil, then the secondary main coil and the primary supportive coil are needed to be provided in a concentric manner with respect to the core, otherwise it was difficult to ensure a good connection between the secondary main coil and the primary supportive coil.

On the contrary to this, the transformer 10 according to the present embodiment has, as shown in FIG. 3, a double layer structure such that the primary main coil 20 wound around the outer peripheral of the middle leg 15 by taking the middle leg 15 of the core 12 as the center, and further winding the secondary main coil 30 around the outer peripheral thereof. By having such double layer structure, even if the primary supportive coil 24 is provided so that it is shifted in the coil direction (Z axis direction) with respect to secondary main coil 30, a good connection between the primary supportive coil 24 and the secondary main coil 30 can be attained. The transformer 10 uses such advantages of the this structure, and have improved the workability during the production by omitting the process to form the barrier by winding the insulation tape around the secondary main coil 30 by winding the primary supportive coil 24 at the section 64 separated by the first intermediate collar part 55 from the section 64 and 65 provided with secondary main coil 30. Therefore, the transformer 10 has accomplished a good connection between the primary supportive coil 24 and the secondary main coil 30, and also easily ensures the secure insulation between the primary supportive coil 24 and the secondary main coil 30; thus has excellent productivity. Also, the transformer 10 having a double layer structure allows shortening the length in the coil direction; thereby the transformer of vertical type with thin thickness can be accomplished.

Also, in the transformer 10 according to the present embodiment, it is necessary to pull the primary supportive coil 24 wound around the second hollow cylinder part 54 of the case 50 to the primary terminals 70. Thus, as shown in FIG. 4, in the transformer 10, the first end part 42*a* provided with the primary terminals 70 is design so that it projects out towards X axis positive direction from the lower collar end part 58*c* of the case 50; thereby the case 50 is prevented from intervening when connecting the supportive coil end part 24*a* with primary terminals 70. Also, by taking such configuration, the case 50 is prevented from being damaged by a heat when soldering the supportive coil end part 24*a* or so to the primary terminals 70.

Further, as shown in FIG. 1 and FIG. 3 the transformer 10 of vertical type is provided with the connection parts 13 and 14 of the core 12 in Z axis vertical direction of the primary main coil 20 and the secondary main coil 30; and these connection parts 13 and 14 has an effect to suppress the leakage flux to the vertical direction. Therefore, the transformer 10 can suppress the leakage flux in the vertical direction of the transformer 10 compared to the horizontal type which the vertical direction of the coil is barely shielded by the core. Therefore, the transformer 10 can prevent the current surge from being generated at the surrounding constituting material or so even without providing the shield made by aluminum or so. Also, by preventing the generation of the current surge, the transformer 10 can reduce the generation of heat or noise generated together with the current surge. Also, the transformer 10 does not have to provide the shield for shielding the leakage flux, thus it has excellent heat dissipation characteristic. Furthermore, the transformer 10 has short length of middle leg 15 and the sidle legs 16 and 18 of the core 12, thus it can prevent the damage to the core due to the impact or so from the outside.

Further, as shown in FIG. 3, the transformer 10 comprises the adhesive agent curing part 82 connecting the first connection part side face 13*a* of the core 12 and the inclined face 61 of the case 50. The adhesive agent curing part 82 shown in FIG. 3 has high durability against the vibration generated in the transformer 10, and can securely fix the core 12 against the case 50; therefore transformer 10 can suppress the tinnitus.

Also, the fixing structure due to the adhesive agent curing part 82 in the transformer 10 is unlikely to have the damages such as an adhesive agent release, or a crack in the case 50, compared to the fixing structure adhering the opposing face against each other of the core 12 and the case 50; therefore it can be suitably applied to the case that the strength of the case 50 is relatively low. Further, the inclined face 61 has an effect to guide the adhesive agent introduced during the assembly to the desired adhesive face, and an effect to reduce the amount of the adhesive agent necessary for the adhering.

As shown in FIG. 1 and FIG. 2, in the transformer 10 according to the present embodiment, at the both sides of the core mounting face 53, the positioning face 60*a* for determining the position of the first connection part side face 13*a* is formed, and the transformer 10 can easily determine the position of the first core 12*a* against the case 50 during the assembly. As shown in FIG. 1, from the point of improving the accuracy of the positioning of the core 12, it is preferable to provide the positioning face 60*a* at both end parts of Y axis direction in the core mounting face 53 so that the inclined face 61 is placed in between. Also, such configuration enables to form the adhesive agent curing part 82 long along Y axis direction, and improves the adhesive strength of the core 12 and the case 50.

Furthermore, the case 50 comprising the inclined face 61 connected to the core 12 by the adhesive agent curing part 82 can be particularly suitably used for the transformer 10 of double layer structure. This is because, at the transformer 10, due to the excellent fixing structure of the case 50 and the core 12, it is possible to use the material such as PET or so which has relatively low strength as the case 50, thus the structure making the assembly easy can be applied such as the inserting structure using the resilient deformation of the side face part 59. Note that, different from the bobbin 40 provided with the terminals 70 and 72, the case 50 does not require a heat resistance necessary for the soldering or so, thus even from such point of view there are wide ranges of selections for the materials.

OTHER EMBODIMENT

Note that, in the above described embodiment, the cross section shape of the middle leg 15 (15*a*, 15*b*) of the core 12 is oval, however the cross section of the middle leg 15 is not limited thereto, and it may be any other shapes such as circular shape, polygonal shape or so. As for the shape of the core 12, it is not limited to the shape comprising two side legs 16 and 18 by placing the middle leg 15 therebetween, and it may be a shape comprising only one side leg. Also, for the shape of the coil shape of the primary main coil 20, the primary supportive coil 24 and the secondary main coil 30, it is not particularly limited, and it may by any other shape such as a circular shape, a polygonal shape or so.

REFERENCE NUMERALS

10 . . . Transformer
12 . . . Core
12*a* . . . First core
12*b* . . . Second core
13 . . . First connection part
13*a* . . . First connection part side face
14 . . . Second connection part
15 . . . middle leg
16,18 . . . Side leg
20 . . . Primary main coil
20*a* . . . Primary coil end part
24 . . . Primary supportive coil
24*a* . . . Supportive coil end part
30 . . . Secondary main coil
30*a* . . . Secondary coil end part
40 . . . Bobbin
42 . . . Base part
42*a* . . . First end part
42*b* . . . Second end part
43 . . . Concave part
44 . . . First hollow cylinder part
44*a* . . . First through hole
47 . . . First bobbin collar part
48 . . . Second bobbin collar part
49 . . . Engaging projection
50 . . . Case
52 . . . Upper collar part
53 . . . Core mounting face
54 . . . Second hollow cylinder part
54*a* . . . Second through hole
55 . . . First intermediate collar part
55*a*, 56*a*, 58*a*. . . Lead grooves
56 . . . Second intermediate collar part
58 . . . Lower collar part
58*c* . . . Lower collar part end part
59 . . . Side face part
59*a* . . . Engaging hole
60 . . . Positioning part
60*a* . . . Positioning face
61 . . . Inclined face
63 . . . First section
64 . . . Second section
65 . . . Third section
70 . . . Primary terminal
72 . . . Secondary terminal
82 . . . Adhesive agent curing part
90 . . . Mounting face

The invention claimed is:

1. A transformer comprising;

a bobbin comprising a base part extending approximately parallel to a mounting face, and a first hollow cylinder part formed at inside with a first through hole inserted by a core projecting out towards a first positive direction approximately perpendicular against said mounting face from said base part, a primary main coil wound around said first hollow cylinder part, a case comprising an upper collar part, a second hollow cylinder part and a lower collar part, said upper collar part formed with a second through hole connecting to said first through hole and extending approximately parallel to said mounting face, said second hollow cylinder part housing said primary main coil inside by projecting out towards a first negative direction which is an opposite direction of said first positive direction from said upper collar part and formed at an outer peripheral face with a first and second section divided by an intermediate collar part projecting out approximately parallel to said mounting face, and said lower collar part connected to an end part opposite to said upper collar part in said second hollow cylinder part and opposing said base part by extending approximately parallel to said mounting face, a primary supportive coil wound around said first section, and a secondary main coil wound around said second section, wherein at a first end part, which is an one end part of said base part and an end part of a second positive direction approximately parallel to said mounting face, 4 or more of primary terminals, connected with both end parts of said primary main coil and said primary supportive coil, are provided, at a second end part, which is the other end part of said base part, plurality of secondary terminals, connected with both end parts of said secondary main coil, are provided, and said secondary main coil is separated by an intermediate collar part and said second hollow cylinder part from any one of primary coil connected to said primary terminals.

2. The transformer as set forth in claim 1, wherein said first end part is spaced apart from said second end part in regards with said second direction, further than a lower collar part end part which is an end part of said second positive direction at said lower collar part.

3. The transformer as set forth in claim 1, wherein said primary supportive coil is provided so that it is closer to said lower collar part than said secondary main coil.

* * * * *